United States Patent [19]

Chapman et al.

[11] 4,081,275

[45] Mar. 28, 1978

[54] PHOTOGRAPHIC FILM UNITS CONTAINING COLORLESS PARA-NITROBENZYLIDENE DYE-FORMING COMPOUNDS

[75] Inventors: Derek Davis Chapman; Thomas Irving Abbott, both of Rochester, N.Y.

[73] Assignee: Eastman Kodak Company, Rochester, N.Y.

[21] Appl. No.: 705,965

[22] Filed: Jul. 16, 1976

[51] Int. Cl.[2] ..... G03C 7/00; G03C 1/40; G03C 1/84; G03C 5/54

[52] U.S. Cl. ..... 96/3; 96/29 D; 96/73; 96/77; 96/84 R; 428/411; 428/412; 428/423; 428/480; 428/500; 428/508; 428/515

[58] Field of Search ..... 96/3, 29 D, 77, 84 R, 96/73; 260/240 A; 428/500, 508, 515, 532, 534, 542, 411, 412, 423, 480

[56] References Cited

U.S. PATENT DOCUMENTS

| | | | |
|---|---|---|---|
| 3,647,437 | 3/1972 | Land | 96/77 |
| 3,984,248 | 10/1976 | Sturmer | 96/89 |

OTHER PUBLICATIONS

Koenigs et al., Berichte, vol. 58, 1925 pp. 933–940.

*Primary Examiner*—David Klein
*Assistant Examiner*—Richard L. Schilling
*Attorney, Agent, or Firm*—Arthur H. Rosenstein

[57] ABSTRACT

A photographic film unit comprises a support having coated thereon at least one photosensitive silver halide emulsion, said layer having associated therewith a dye image-providing material, a dye image-receiving layer, means for discharging an alkaline processing composition within the film unit and at least one layer containing at least one para-nitrobenzylidene dye-forming compound. Some of the para-nitrobenzylidene dye-forming compounds are a dark color at moderately and highly alkaline conditions and are colorless at neutral or only slightly alkaline conditions such as at ambient conditions.

28 Claims, No Drawings

PHOTOGRAPHIC FILM UNITS CONTAINING COLORLESS PARA-NITROBENZYLIDENE DYE-FORMING COMPOUNDS

The present invention relates to photographic elements comprising a layer containing a normally colorless para-nitrobenzylidene dye which becomes colored in alkaline solution.

In the photographic field, generally, an exposed photographic element is developed, either physically or chemically, under relative processing conditions in a dark environment. Development in the absence of light is necessary to avoid the exposure to nonimage or image areas during development which leads to fogging.

In certain instances, the element can be surrounded with an opaque layer material after exposure and the element can then be subjected to room light conditions before or during processing.

U.S. Pat. No. 3,498,787 describes direct-print photographic materials which contain, in a filter layer, the colorless form of an indicator dye which on treatment with an alkaline solution is converted to a yellow dye to reduce printout on continued exposure to actinic light.

The formation of high density opaque layers is particularly important with integral image color transfer processes where the processing solution is used to form one of the opaque layers prior to the removal of the film unit from the camera. The silver halide layers must be kept in complete darkness during development.

U.S. Pat. Nos. 3,607,685 and 3,647,437 describe the incorporation into the processing composition of an opacifying material so that, when the film pack is outside the camera, it is protected from light by the opacifier spread with the processing composition. The use of dyes in general which change color according to pH values in combination with light-reflective pigments is also described in forming a separate layer to protect the element from light exposure in U.S. Pat. No. 3,647,437.

The use of an opacifier such as carbon in the processing composition, however, must be uniform and any discontinuities in the opacity of the liquid layer results in light leaks which become manifested as spot defects of dye in the receiving layer. These discontinuities can be caused by bubbles of gas and undissolved particles of the materials in the processing composition, causing thin spots in the layer formed which allows light to enter.

According to the present invention, there is provided a photographic element comprising a layer containing a para-nitrobenzylidene dye-forming compound which is colorless at approximately neutral pH and becomes highly colored when contacted by alkaline fluid. The dye remains stable for as long as the processing in alkaline fluid proceeds.

Therefore, one embodiment of this invention comprises a photographic element comprising a transparent layer containing said para-nitrobenzylidene dye-forming compounds.

In a preferred embodiment, a photographic film unit comprises a) a support having thereon at least one photosensitive silver halide emulsion layer having associated therewith a dye image-providing material, b) a dye image-receiving layer, c) means for discharging an alkaline processing composition within said film unit and d) at least one layer containing at least one para-nitrobenzylidene dye-forming compound as described below.

The layer containing the dye is preferably positioned on the side of the silver halide emulsion layer opposite that of the image-receiving layer.

A further embodiment of this invention comprises a cover sheet for use with a color diffusion transfer film unit comprising a transparent support having thereon a neutralizing layer and a timing layer, and a layer comprising a para-nitrobenzylidene dye-forming compound as described below.

The para-nitrobenzylidene dye-forming compounds which have the unique properties described above and which can be included in layers of photographic elements to exclude light from the element during processing have the formula:

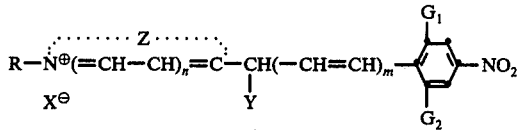

wherein:

$n$ is 0 or 1;

$m$ is 0 or 1;

Y is hydrogen;

a carboxylic ester group preferably having the formula $R_2OCO$ wherein $R_2$ is hydrogen, alkyl preferably containing from 1–18 carbon atoms such as methyl, ethyl, octyl and the like; aryl preferably containing from 6–10 carbon atoms such as phenyl and naphthyl; aralkyl preferably containing from 6–8 carbon atoms such as tolyl, phenylethyl and the like or a carbamyl group preferably having the formula $NR_3R_4CO$— wherein $R_3$ and $R_4$ are independently selected from the group consisting of hydrogen; alkyl preferably containing from 1–12 carbon atoms such as methyl, propyl, butyl decyl and the like; aryl preferably containing from 6–10 carbon atoms such as those described above; aralkyl preferably containing from 6–8 carbon atoms such as those described above and the like;

if $m$ is 1, then Y must be hydrogen, but if $m$ is 0, then Y can additionally have the formula:

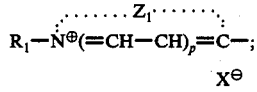

Z and $Z_1$ independently represent the nonmetallic atoms necessary to complete a 5- or 6-membered heterocyclic ring whose skeletal atoms consist of the nitrogen atoms and carbon atoms depicted in the formula and at least one other atom chosen from the group consisting of carbon, nitrogen, oxygen, selenium and sulfur atoms;

the heterocyclic nucleus preferably is selected from the group consisting of pyridine (for example, 2-pyridine, 5-methyl-2-pyridine, 4-pyridine, 3-methyl-4-pyridine, nitro-group-substituted pyridines, etc.); quinoline (e.g., quinoline, 6-methylquinoline, 6-methoxyquinoline, 6-ethoxyquinoline, 6-chloroquinoline, 4-methoxyquinoline, 8-methoxyquinoline, β-methylquinoline, 4-chloroquinoline, 6-nitroquinoline, etc.); thiazole (e.g., 4-methylthiazole, 4-phenylthiazole, 4,5-diphenylthiazole, 4-(2-thienyl)thiazole); selenazole (for example, 4-methylselenazole, 4-nitroselenazole, 4-phenylselenazole); benzimidazole (e.g., 5-chloro-1,3-dialkylbenzimidazole, 5-chloro-1,3-diarylbenzimidazole, 5,6-dichloro-1,3-diaryl-benzimidazole, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diaryl[2,1-d]imidazole); and imidazole (e.g., imidazole, 1-alkylimidazole and the like);

R and $R_1$ are independently alkyl containing one or more carbon atoms and preferably from about 4 to about 18 carbon atoms such as butyl, secondary butyl, isobutyl, tert-butyl, pentyl, hexyl, octyl, decyl, dodecyl, octadecyl and the like, including substituted alkyl such as aralkyl such as phenylbutyl, haloalkyl such as chlorobutyl, and amino-substituted-alkyls, hydroxyalkyls, carboxyalkyls, sulfoalkyls, acyloxyalkyls, alkoxycarbonylalkyls and the like;

preferably, at least one of R, $R^1$ and Y should contain at least 10 carbon atoms in order to prevent diffusion of the dye out of its layer;

*p* is 0 or 1;

$X^{\ominus}$ is independently an acid anion such as chloride, bromide, p-toluenesulfonate, methanesulfonate, ethanesulfonate, methyl sulfate, ethyl sulfate, perchlorate and the like; and $G_1$ and $G_2$ are independently selected from the group consisting of hydrogen or an electron-withdrawing group such as halogen such as chloro, bromo, and the like; trihalomethyl such as trichloromethyl, trifluoromethyl and the like; cyano; alkoxycarbonyl such as methoxycarbonyl, ethoxycarbonyl and the like; carbamoyl; alkylsulfonyl such as ethylsulfonyl, butylsulfonyl and the like; arylsulfonyl such as phenylsulfonyl and the like; sulfamoyl and equivalent electron-withdrawing groups, except that neither $G_1$ nor $G_2$ can be nitro.

Examples of suitable dye-forming compounds include 2-p-nitrobenzyl-1-octadecylpyridinium perchlorate, 1-n-butyl-2-p-nitrobenzylpyridinium p-toluenesulfonate, 4,4'-p-nitrobenzylidenebis(1-ethylquinolinium chloride) and the like.

There are a number of methods of preparing the colorless dye-forming compounds according to this invention. For example, nitrobenzylpyridine can be heated in the presence of an alkyl halide or sulfonate such as ethyl p-toluenesulfonate. Other methods are described, for example, in Berichte, vol. 58, 1925, pp. 933–940. Another method is to form colored para-nitrobenzylidene dyes analogous to the colored ortho-nitrobenzylidene dyes described in Sturmer U.S. Pat. 3,984,248, and react with acid such as p-toluenesulfonic acid, hydrochloric acid and the like to form the colorless dye-forming compound according to this invention.

The dye-forming compounds generally have a pKa greater than 7 and must be colorless at neutral pH. It is noted that it is critical that the groups $G_1$ and $G_2$ not be nitro such as depicted in the Sturmer U.S. Pat. No. 3,984,248 as this would render the dye-forming compound light-bleachable which would destroy its utility. The dye-forming compounds, according to the present invention, contain a nitro group only in the para position of the benzene radical and are not light-bleachable. They are colorless and change to the colored form at high pH such as 8.5 to 13.

The dyes, according to this invention, can be coated in any layer of a photographic element. In photographic processes other than image-transfer processes, the dye-forming compound can be incorporated in a transparent layer. The light-sensitive component can comprise any light-sensitive material such as azo dyes, silver halide, nonsilver salts, and the like. For optimum results, the light-sensitive layer is positioned between a support and the transparent layer containing the dye-forming compound. The element can be exposed through the transparent layer containing the colorless dye-forming compound and immersed in an alkaline processing bath to develop the image in the presence of light. The layer containing the dye-forming compound will become colored on contact with the alkaline solution and shield the imaging layer from light during development. The image can be viewed from the opposite side or, if the colored dye then reverses back to a colorless form when removed from the alkaline system, can be viewed from either side.

The colorless dye-forming compounds are most useful in photographic processes wherein an image is obtained by diffusion transfer and at least a part of the processing takes place outside of a camera.

In color diffusion transfer assemblages, a "shutdown" mechanism is needed to stop development after a predetermined time, such as 20–60 seconds in some formats or up to 3 minutes in others. Since development occurs at a high pH, it can be stopped by merely lowering the pH. The use of a neutralizing layer such as a polymeric acid can be employed for this purpose which will stabilize the element after the required diffusion of dyes has taken place. A timing layer is employed in conjunction with the neutralizing layer so that the pH is not prematurely lowered which would stop development. The development time is thus established by the time it takes the alkaline compositon to penetrate through the timing layer. As the system starts to become stabilized, alkali is depleted throughout the structure, causing silver halide development to cease in response to this drop in pH. For each image-generating unit, this shutoff mechanism can establish the amount of silver halide development and the related amount of dye formed according to the respective exposure values.

Various formats for color diffusion transfer assemblages are described in the prior art such as U.S. Pat. Nos. 2,983,606, 2,543,181, 3,415,644, 3,415,645, 3,415,646, 3,647,437, 3,635,707 and 3,756,815 and Canadian Pat. Nos. 928,559 and 674,082. In these formats, the image-receiving layer containing the photographic image for viewing can remain permanently attached and integral with the image-generating and ancillary layers present in the structure when a transparent support is employed on the viewing side of the assemblage. The image is formed by dyes, produced in the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image-generating layers begin to diffuse throughout the structure. At least a portion of the imagewise distribution of diffusible dyes diffuses to the dye image-receiving layer to form an image of the original subject.

For many purposes, it is desirable to expose the photosensitive layer through the cover sheet and to view the resulting transferred image through the transparent support on the other side of the photosensitive layers. The image color-providing materials can diffuse through an opaque layer between the receiving layer and the photosensitive layers. Thus, the photosensitive layer must also be protected from light exposure during processing through the cover sheet without interfering with the exposure prior to development. This is possible by adding an opaque material to the processing solution which is not in contact with the photosensitive layers prior to processing. However, after the film pack is released from the camera, the opaque layer may not be extremely uniform and spot defects due to light escaping through the processing layer may result.

The use of the colorless dye-forming compounds according to the present invention in a layer anywhere in the film pack, but preferably between the photosensitive layer or layers and the outermost layers of the cover sheet, alleviates much of these problems. The cover sheet can be used as the sole light-preventing layer, if desired. The layer containing the colorless dye-forming compounds will transmit light for the image formation and when contacted with the alkaline processing material change color so that substantially no light is transmitted to the photosensitive layers during processing.

In the preferred embodiment, the processing composition must penetrate the layer containing the dye-forming compound before it penetrates the light-sensitive layer, preferably a silver halide layer or layers. This is easily accomplished either by positioning the layer containing the dye-forming compound between the processing composition and the light-sensitive layer or, alternatively, by positioning the layer containing the dye-forming compound on the side of the processing composition opposite that of the light-sensitive layer either adjacent the processing composition or close enough to the processing composition that the processing composition penetrates the layer containing the dye-forming compound prior to penetrating the light-sensitive layer.

A photographic assemblage according to this invention comprises:

a. a support having thereon at least one photosensitive silver halide emulsion layer having associated therewith a dye image-providing material;
b. a dye image-receiving layer;
c. means for discharging an alkaline processing composition within the assemblage;
d. a layer containing the para-nitrobenzylidene dye-forming compound described above.

A preferred film unit comprises:

a. a support having thereon at least one photosensitive silver halide emulsion layer having associated therewith a dye image-providing material;
b. a dye image-receiving layer;
c. a means for discharging an alkaline processing composition within the assemblage;
d. a neutralizing layer for neutralizing said alkaline processing composition after a predetermined time; and
e. a timing layer which is permeable by said alkaline processing composition after said predetermined time (preferably between said acid layer and the alkaline processing composition); and
f. a layer containing at least one para-nitrobenzylidene dye-forming compound described above (preferably between the timing layer and a photosensitive silver halide emulsion layer).

A preferred embodiment of an assemblage of an integral negative-receiver color diffusion transfer film unit in which the layer containing the para-nitrobenzylidene dye-forming compound can be employed is disclosed in Canadian Pat. No. 928,559. In this embodiment, the support for the photosensitive element is transparent and is coated with the image-receiving layer, a light-reflective layer, an opaque layer, and photosensitive layers, having associated therewith dye image-providing material layers. A rupturable container containing an alkaline processing composition is positioned adjacent the top layer and a transparent cover sheet. The cover sheet comprises a transparent support which is coated with a neutralizing layer and a timing layer and the layer comprising the para-nitrobenzylidene dye-forming compound. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the assemblage, raising the pH and then changing the colorless dye-forming material to a light-blocking colored dye to aid in protecting the image-forming portion of the assemblage from exposure. The processing composition develops each silver halide layer and dye images are formed as a result of development which diffuse to the image-receiving layer to provide a right-reading image which is viewed through the transparent support on the opaque reflecting layer background. The neutralizing layer then neutralizes the alkaline processing composition after the timing layer of the invention breaks down, thus "shutting off" the system. For further details concerning the format of this particular integral assemblage, reference is made to the above-mentioned Canadian Pat. No. 928,559, which is incorporated herein by reference.

Another useful integral format in which this invention can be employed is described in U.S. Pat. Nos. 3,415,645, 3,415,646, 3,647,437 and 3,635,707 and British Pat. No. 1,330,524.

The photosensitive element useful in this invention can be treated with an alkaline processing composition to effect or initiate development in any manner. A preferred method for applying processing composition is by use of a rupturable container or pod which contain the composition. In general, the processing composition employed in this invention contains the developing agent for development, although the composition could also be just an alkaline solution where the developer is incorporated in the photosensitive element, in which case the alkaline solution serves to activate the incorporated developer.

The dye image-providing materials which may be employed in this invention generally may be characterized as either (1) initially soluble or diffusible in the processing composition but selectively rendered nondiffusible in an imagewise pattern as a function of development, such as those disclosed, for example, in U.S. Pat. Nos. 2,647,049, 2,661,293, 2,698,244, 2,698,798, 2,802,735, 2,774,668 and 2,983,606, or (2) initially insoluble or nondiffusible in the processing composition but selectively rendered diffusible in an imagewise pattern as a function of development, such as those disclosed, for example, in U.S. Pat. Nos. 3,227,550, 3,227,551, 3,227,552, 3,227,554, 3,243,294 and 3,445,228. These materials may be preformed dyes or dye precursors, e.g., color couplers, oxichromic compounds and the like.

In a preferred embodiment of this invention, the dye image-providing material is a nondiffusible redox dye releaser. Such compounds are, generally speaking, compounds which can be oxidized by oxidized developing agent, i.e., crossoxidized, to provide a species which as a function of oxidation will release a diffusible dye, such as by alkaline hydrolysis. Such redox dye releasers are described in U.S. Pat. Nos. 3,725,062 of Anderson and Lum issued Apr. 3, 1973, 3,698,897 of Gompf and Lum issued Oct. 17, 1972, 3,628,952 of Puschel et al issued Dec. 21, 1971, 3,443,939 of Bloom et al issued May 13, 1969, 3,443,940 of Bloom et al issued May 13, 1969, 3,942,987 of Landholm et al, 3,931,144 of Eldridge et al, 3,922,381 of Haase et al and 3,954,476 of Krutak et al, British Pat. No. 1,405,662, and Belgian Pat. No. 810,195 issued July 25, 1974, the disclosures of which are hereby incorporated by reference.

In an especially preferred embodiment of this invention, the redox dye releasers in British Patent No. 1,405,662 referred to above are employed. Such compounds are nondiffusible sulfonamido compounds which are alkali-cleavable upon oxidation to release a diffusible dye from the benzene nucleus and have the formula:

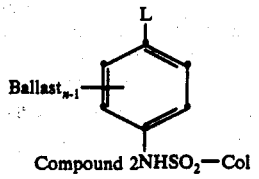

wherein:

1. Col is a dye or dye precursor moiety;
2. Ballast is an organic ballasting radical of such molecular size and configuration (e.g., simple organic groups or polymeric groups) as to render the compound nondiffusible during development in an alkaline processing composition;
3. L is OR$^5$ of NHR$^6$ wherein R$^5$ is hydrogen or a hydrolyzable moiety and R$^6$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc. (when R$^6$ is an alkyl group of greater than 6 carbon atoms, it can serve as a partial or sole Ballast group); and
4. *n* is a positive integer of 1 to 2 and is 2 when G is OR$^5$ of when R$^6$ is a hydrogen or an alkyl group of less than 8 carbon atoms.

For further details concerning the above-described sulfonamido compounds and specific examples of same, reference is made to the above-mentioned Fleckenstein et al published application Ser. No. B351,673, British Pat. No. 1,405,662 and Belgian Pat. No. 799,268, issued February 28, 1972, the disclosures of which are hereby incorporated by reference.

Sulfonamido compounds which can be employed in this invention include the following:

Compound 1

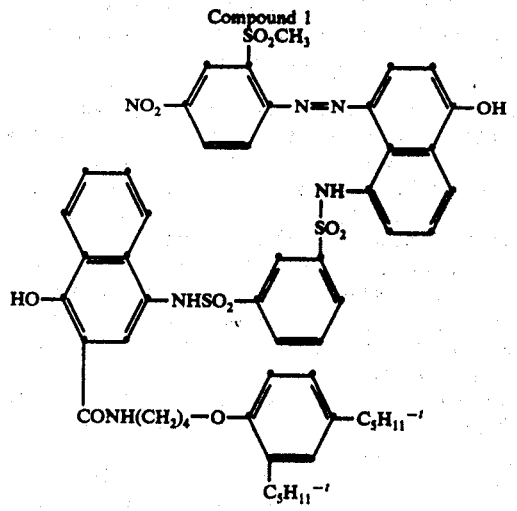

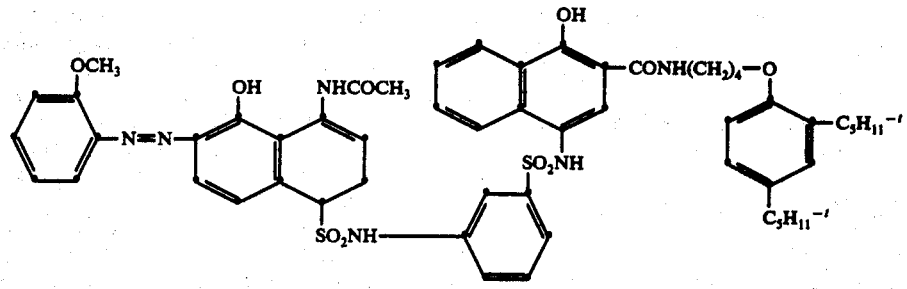

Compound 3

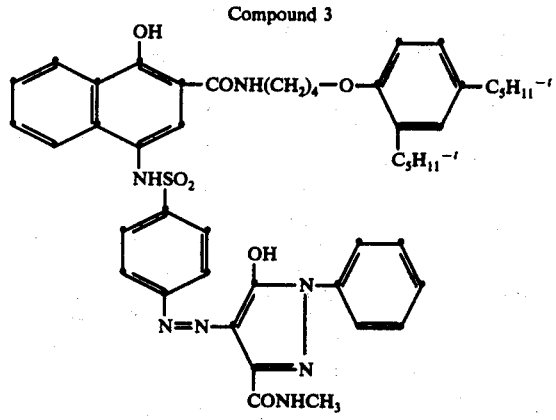

In another preferred embodiment of the invention, initially diffusible dye image-providing materials are employed such as dye developers, including metal complexed dye developers such as those described in U.S. Pat. Nos. 3,453,107, 3,544,545, 3,551,406, 3,563,739, 3,597,200 and 3,705,184, and oxichromic developers as described by Lestina and Bush, U.S. Pat. No. 3,880,658 issued April 29, 1975, the disclosures of which are hereby incorporated by reference. When oxichromic developers are employed, the image is formed by the diffusion of the oxichromic developer to the dye image-receiving layer where it undergoes chromogenic oxidation to form an image dye.

The assemblage of the present invention may be used to produce positive images in single- or multicolors. In a three-color system, each silver halide emulsion layer of the film assembly will have associated therewith a dye image-providing material possessing a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentration of the dye image-providing materials that are employed in the present invention may be varied over a wide range depending upon the particular compound employed and the results which are desired. For example, the dye image-providing compounds may be coated as dispersions in layers by using coating solutions containing a ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Any silver halide developing agent can be employed in this invention depending upon the particular chemistry system involved. The developer may be employed in the photosensitive element to be activated by the alkaline processing composition. Specific examples of developers which can be employed in this invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylenediamine N,N,N',N'-tetramethyl-p-phenylenediamine, etc.
4-hydroxymethyl-4-methyl-1-phenyl-3-pyrazolidinone, etc.

In using redox dye-releasing compounds in this invention, the production of diffusible dye images is a function of development of the silver halide emulsions with a silver halide developing agent to form either negative or direct-positive silver images in the emulsion layers. If the silver halide emulsion employed forms a direct-positive silver image, such as a direct-positive internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the assemblage develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the redox dye-releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuses to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pat. Nos. 3,761,276 issued Sept. 25, 1973, 3,761,266 issued Sept. 25, 1973, and 3,761,267 issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 second, and developing for 3 minutes at 20° C. in Developer A below ("internal-type" developer), have a maximum density at least five times the maximum density obtained when an equally exposed silver halide emulsion is developed for 4 minutes at 20° C. in Developer B described below ("surface-type" developer). Preferably, the maximum density in Developer A is at least 0.5 density unit greater than the maximum density in Developer B.

| Developer A | |
|---|---|
| hydroquinone | 15 g. |
| monomethyl-p-aminophenol sulfate | 15 g. |
| sodium sulfite (desiccated) | 50 g. |
| potassium bromide | 10 g. |
| sodium hydroxide | 25 g. |
| sodium thiosulfate | 20 g. |
| water to make 1 liter | |

| Developer B | |
|---|---|
| p-hydroxyphenylglycine | 10 g. |
| sodium carbonate | 100 g. |
| water to make 1 liter | |

The internal-image silver halide emulsions when processed in the presence of fogging or nucleating agents provide direct-positive silver images. Such emulsions are particularly useful in the above-described embodiment. Suitable fogging agents include the hydrazines disclosed by Ives U.S. Pat. Nos. 2,588,982 issued Mar. 11, 1952, and 2,563,785 issued Aug. 7, 1951; the hydrazides and hydrazones disclosed by Whitmore U.S. Pat. No. 3,227,552 issued Jan. 4, 1966; hydrazone quaternary salts described in British Pat. No. 1,283,835 and U.S. Pat. No. 3,615,615; hydrazone-containing polymethine dyes described in U.S. Pat. No. 3,718,470; or mixtures thereof. The quantity of fogging agent employed can be widely varied depending upon the results desired. Generally, the concentration of fogging agent is from about 0.4 to about 8 g./mole of silver in the photosensitive layer in the photosensitive element or from about 0.1 to about 2 g./liter of developer if it is located in the developer. The fogging agents described in U.S. Pat. Nos. 3,615,615 and 3,718,470, however, are preferably used in concentrations of 0.5 to 10 mg./mole of silver in the photosensitive layer.

Typical useful direct-positive emulsions are disclosed in U.S. Pat. Nos. 3,227,552 by Whitmore issued Jan. 4, 1966, 3,761,276 by Evans issued Sept. 25, 1973; 3,761,267 by Gilman et al, 3,761,266 by Milton, 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are described, for example, in U.S. Pat. Nos. 3,367,778 by Berriman issued Feb. 6, 1968, and 3,501,305, 3,501,306 and 3,501,307 by Illingsworth, all issued Mar. 17, 1970.

In still other embodiments, the direct-positive emulsions can be of the type described by Mees and James, *The Theory of the Photographic Process,* published by MacMillan Co., New York, N.Y., 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,723,051, 3,056,492, 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color photographic assemblage according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 1 to 7 microns in thickness; and the alkaline solution-permeable polymeric interlayers, e.g., gelatin, are about 1 to 5 microns in thickness. Of course, these thicknesses are approximate only and can be modified according to the product desired.

The alkaline solution-permeable, light-reflective layer employed in certain embodiments of photographic assemblages of this invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes, may be added to it, or carbon black, nigrosine dyes, etc., may be coated in a separate layer adjacent the light-reflective layer.

The neutralizing layer employed in this invention which becomes operative after permeation of the processing composition through the timing layer will effect a reduction in the pH of the image layers from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030, may be employed with good results. Such neutralizing or pH-lowering materials reduce the pH of the film unit after development to terminate development and substantially reduce further dye transfer and thus stabilize the dye image.

The timing layers employed in this invention are generally coated over the acid neutralizing layer. Various examples of timing-layer materials useful are disclosed in an article in *Research Disclosure,* 12331, vol. 123, July, 1974, entitled "Neutralizing Materials in Photographic Elements". The list of materials disclosed includes cellulose derivatives, vinyl polymers, acrylate polymers, polyesters, polycarbonates, polyurethanes and mixtures thereof. One of the vinyl polymers disclosed includes a maleic anhydride copolymer.

Prior-art patents relating to various timing-layer materials include U.S. Pat. Nos. 3,362,819, 3,455,686, 3,415,644, 3,414,411, 3,785,815 and 3,575,701 and British Pat. No. 1,340,349. A particularly preferred timing layer is a mixture of cellulose acetate and a maleic anhydride copolymer, said mixture comprising about 2 to about 20% by weight of said copolymer, which is described in U.S. Pat. No. 4,009,030.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basis polymeric mordants such as polymers of amino guanidine derivatives of vinyl methyl ketone, such as described by Minsk U.S. Pat. No. 2,882,156 issued Apr. 14, 1959, and basic polymeric mordants such as described in U.S. Pat. Nos. 3,709,690, 3,625,694, 3,898,088 of Cohen et al issued Aug. 5, 1975, and 3,859,096 of Burness et al issued Jan. 7, 1975. Other mordants useful in this invention include poly-4-vinylpyridine, the 2-vinyl pyridine polymer methyl-p-toluene sulfonate and similar compounds described by Sprague et al U.S. Pat. No. 2,484,430 issued Oct. 11, 1949, and cetyl trimethylammonium bromide, etc. Effective mordanting compositions are also described in U.S. Pat. Nos. 3,271,148 by Whitmore and 3,271,147 by Bush, both issued Sept. 6, 1966, and in U.S. Pat. No. 3,958,995.

Other materials useful in the dye image-receiving layer include alkaline solution-permeable polymeric layers such as N-methoxymethyl polyhexylmethylene adipamide, partially hydrolyzed polyvinyl acetate, and other materials of a similar nature. Generally, good results are obtained when the image-receiving layer, preferably alkaline solution-permeable, is transparent and about 0.25 to about 0.40 mil in thickness. This thickness, of course, can be modified depending upon the result desired. The image-receiving layer can also contain ultraviolet-absorbing materials to protect the mordanted dye images from fading due to ultraviolet light, brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g., sodium hydroxide, sodium carbonate or an amine such as diethylamine, preferably possessing a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of this invention, an opacifying agent, e.g., $TiO_2$, carbon black, indicator dyes, etc., may be added to the processing composition. In addition, ballasted indicator dyes and dye precursors may also be present in the photographic assemblage as a separate layer on the exposure side of the photosensitive layers, the indicator dyes being preferably transparent during exposure and becoming colored or opaque after contact with alkali from the processing composition.

The supports for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethylene-terephthalate) film, polycarbonate film, poly-α-olefins such as polyethylene and polypropylene film, and related films or resinous materials. The support is usually about 2 to 9 mils in thickness. Ultraviolet-absorbing materials may also be included in the supports or as a separate layer on the supports, if desired.

The silver halide emulsions useful in this invention are well-known to those skilled in the art and are described in *Product Licensing Index, vol.* 92, December, 1971, publication 9232, p. 107, paragraph I, "Emulsion types"; they may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated by using the various techniques described on p. 109, paragraph XVIII, "Coating procedures", of the above article; the disclosures of which are hereby incorporated by reference.

The following examples further illustrate the invention.

EXAMPLE A

A mixture of 1-octadecyllepidinium p-toluenesulfonate (24.6 g.), 2-chloro-5-nitrobenzotrifluoride (10 g.) and acetonitrile (700 ml.) was treated with diisopropylethylamine (20.7 g.) and refluxed for 6 hours with stirring. After filtering and evaporating, 1,4-dihydro-4-(4-nitro-2-trifluoromethylbenzylidene)-1-octadecylquinoline was formed. This colored dye was changed to the colorless compound having the formula:

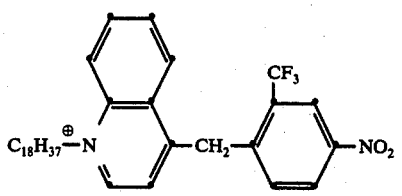

by reacting with a molar equivalent of p-toluenesulfonic acid in methanol.

EXAMPLE B 2-(4-Nitrobenzyl)pyridine (4 g.) was heated for 16 hr. at 135° C. with n-octadecyl p-toluenesulfonate (8 g.). The salt was then dissolved in methanol and added to an aqueous solution of sodium perchlorate. The resulting compound had the structure:

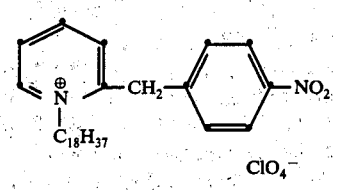

EXAMPLE C 2-(4-Nitrobenzyl)pyridine (4.28 g.) and butyl p-toluenesulfonate (4.56 g.) were heated over a steam bath for 16 hr. The product, after crystallizing and filtration, had the formula:

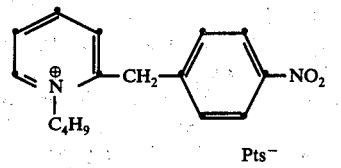

The bromide salt was also prepared as above using 3.2 g. n-butyl bromide and 5 g. of 2-(4-nitrobenzyl)pyridine.

EXAMPLE D

1-Octadecyl-4-phenylthioquinolinium p-toluene-sulfonate (3.3 g.) and ethyl 4-nitrophenyl acetate (1.05 g.) were heated in ethanol in the presence of triethylamine. The reaction mixture was diluted with water and the product was filtered off and recrystallized and had the formula:

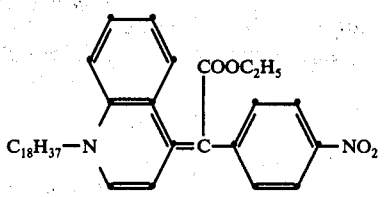

EXAMPLE E

1-Ethyl-4-phenylthioquinolinium p-toluenesulfonate (4.37 g.) and 4-nitrophenylacetic acid (0.99 g.) dissolved in acetonitrile were treated with triethylamine and left standing at room temperature for 16 hr. After removal of the solvent and treatment of the residue with aqueous sodium iodide, the colored product had the formula:

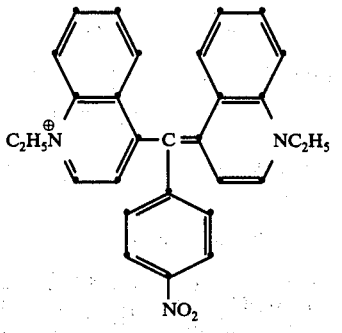

The colored dye was converted to the colorless dye-forming compound by isolating it as the iodide salt and converting 8 g. to the chloride salt by stirring with the chloride salt of a quaternary ammonium ion-exchange resin (Amberlite®) in methanol solution. After removal of the resin by filtration, methanolic HCl was added until the dye color disappeared and the methanol was removed to yield the colorless dye-forming compound having the formula:

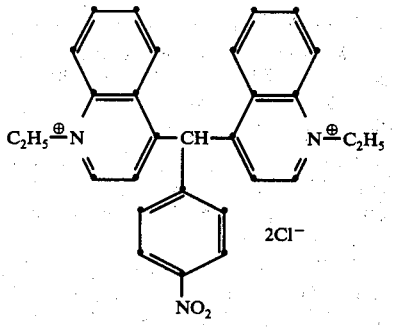

EXAMPLE 1

Two cover sheets were prepared as follows:

Control — The following layers were coated on a poly(ethylene terephthalate) support (coverages throughout the example in parentheses are in g./m.$^2$ unless otherwise indicated):

1. a polyacrylic acid layer (15.5)
2. a timing layer of 95/5 mixture of cellulose acetate (40% acetyl) and poly(styrene-co-maleic anhydride) (4.3)

Example 1 Cover Sheet — To the control sheet was coated a third layer:

3. a 2/1 mixture of cellulose acetate (40% acetyl) and poly(styrene-co-maleic anhydride) (1.9) containing 1-butyl-2-p-nitrobenzylpyridinium bromide (as prepared in Example C) (0.75)

Samples of an integral multicolor photographic element processed using the above cover sheets comprised the following layers in the order given on a poly(ethylene terephthalate) film support:

1. image-receiving layer of a mixture of poly(styrene-co-N-vinylbenzyl-N-benzyl-N,N-dimethylammonium chloride-co-divinylbenzene) (2.2) and gelatin (2.2)
2. reflecting layers of titanium dioxide (21.5) and gelatin (3.2)
3. opaque layer of carbon black (2.7) and gelatin (1.7)
4. Compound A[1] (0.54) dispersed in gelatin (1.2)

[1]See next page for identification of compounds.

5. red-sensitive, internal-image direct-positive gelatin-silver bromide emulsion (1.2 Ag, 1.1 gelatin), 5-secoctadecylhydroquinone-2-sulfonic acid (16 g./mole silver) and fogging agent Compound D[1] (2.0 g./mole silver)
6. interlayer of gelatin (1.6) and 2,5-di-sec-dodecylhydroquinone (1.1)
7. Compound B[1] (0.54) dispersed in gelatin (1.2)
8. green-sensitive, internal-image direct-positive gelatin-silver bromide emulsion (1.2 Ag, 1.1 gelatin), 5-sec-octadecylhydroquinone-2-sulfonic acid (16 g./mole Ag) and fogging agent Compound D[1] (2.0 g./mole Ag)
9. interlayer of gelatin (1.6) and 2,5-di-sec-dodecylhydroquinone (1.1)
10. Compound C[1] (0.65 dispersed in gelatin) (1.2)

11. blue-sensitive, internal-image direct-positive gelatin-silver bromide emulsion (1.1 Ag, 0.75 gelatin), 5-sec-octadecylhydroquinone-2-sulfonic acid (16 g./mole Ag) and fogging agent Compound D[1] (2.5 g/mole Ag).

[1]Compound Identification

Compound A

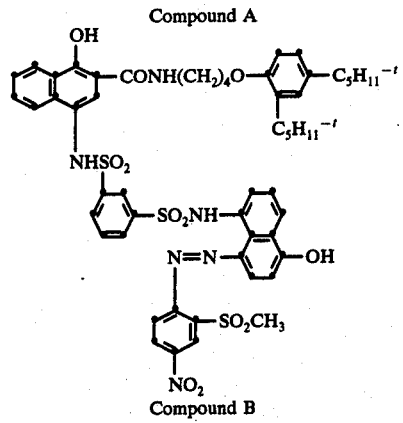

Compound B

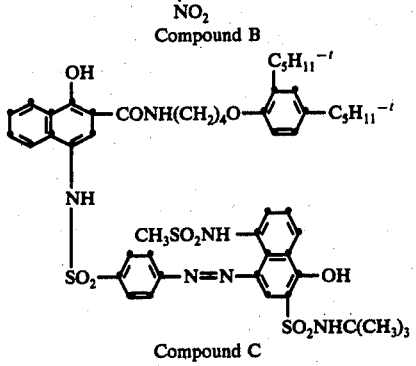

Compound C

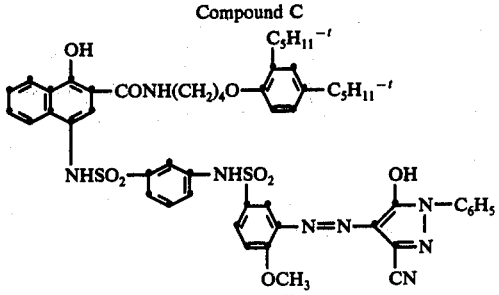

Compound D

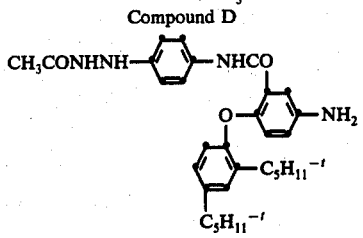

The samples of the element were exposed uniformly such that only the amount of dye corresponding to the direct-positive $D_{min}$ was transferred. The following processing composition in a pod was spread between each photosensitive sheet and the cover sheets by passing the transfer "sandwich" between a pair of juxtaposed rollers so that the liquid layer was between 65 and 70 μm.

| Processing Composition | |
|---|---|
| sodium hydroxide | 64.0 g. |
| 4-hydroxymethyl-4-methyl-1-phenyl-3-pyrazolidone | 8.0 g. |
| 5-methylbenzotriazole | 2.4 g. |
| t-butylhydroquinone | 0.2 g. |
| sodium sulfite (anhyd.) | 2.0 g. |
| carbon | 100.0 g. |
| carboxymethylcellulose | 51.0 g. |
| water | 1.0 l. |

The laminated sandwiches (cover side up) were placed immediately under a 650-watt tungsten-halogen light source to reduce infrared transmission. The laminates were exposed to 15,000 ft. candles for 2 min. at 27° C.

The opposite sides of the laminates were then visually observed for spot defects due to light penetrating the element during the processing. It was found that the spots in the laminate containing the cover sheet of Example 1 were notably devoid of magenta dye while magenta dye was observed in the laminate including the control cover sheet.

A second test similar to the above was performed except that the process was carried out for 2 min. under the bright light filtered through a Wratten 55 green filter which absorbed much of the light that the filter layer of magenta-purple dye could not absorb.

The laminate containing the cover sheet of Example 1 was substantially free of spot defects while the laminate containing the control cover sheet contained many spot defects of magenta dye.

The dyes of Examples A, B, D and E were tested in the same manner with comparable results.

The invention has been described in detail with particular reference to certain preferred embodiments thereof, but it will be understood that variations and modifications can be effected within the spirit and scope of the invention.

What is claimed is:

1. A photographic element comprising a support, a light-sensitive layer and a transparent layer containing at least one dye-forming compound having the formula:

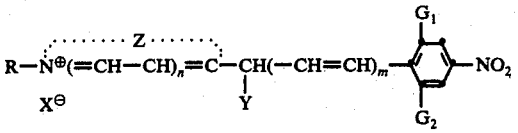

wherein:

*n* is 0 or 1;

*m* is 0 or 1;

*Y* is hydrogen, a carboxylic ester group or a carbamoyl group wherein if *m* is 1, Y is hydrogen, and if *m* is 0, Y can additionally have the formula:

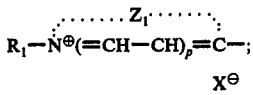

Z and $Z_1$ independently represent the nonmetallic atoms necessary to complete a 5- or 6-membered heterocyclic ring whose skeletal atoms consist of the nitrogen atoms and carbon atoms depicted in the formula and at least one other atom chosen from the group consisting of carbon, nitrogen, oxygen, selenium and sulfur atoms;

R and $R_1$ are independently alkyl containing at least 4 carbon atoms;

*p* is 0 or 1;

$X^{\ominus}$ is independently an acid anion; and $G_1$ and $G_2$ are independently selected from the group consisting of hydrogen or an electron-withdrawing group except that neither $G_1$ or $G_2$ can be nitro wherein the light-sensitive layer is positioned between said support and said transparent layer.

2. The photographic element of claim 1 wherein said light-sensitive layer comprises at least one silver halide emulsion layer.

3. The photographic element of claim 2 wherein at least one silver halide emulsion layer is positioned between an opaque layer and said transparent layer.

4. A photographic element comprising at least one silver halide emulsion layer positioned between a transparent layer containing the dye-forming compound 1-butyl-2-p-nitrobenzylpyridinium bromide and a transparent support.

5. A photographic element comprising at least one silver halide emulsion layer positioned between a transparent layer containing the dye-forming compound 1-butyl-2-p-nitrobenzylpyridinium para-toluenesulfonate and a transparent support layer.

6. A photographic element comprising at least one silver halide emulsion layer positioned between a transparent layer containing a dye-forming compound and a transparent support layer, said dye-forming compound having the structure:

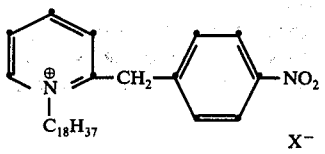

wherein $X^-$ is an acid anion.

7. A photographic element comprising at least one silver halide emulsion layer positioned between a transparent layer containing a dye-forming compound and a transparent support layer, said dye-forming compound having the structure:

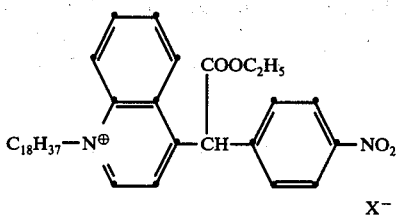

where $X^-$ is an acid anion.

8. A photographic element comprising at least one silver halide emulsion layer positioned between a transparent layer containing a dye-forming compound and a transparent support layer, said dye-forming compound having the structure:

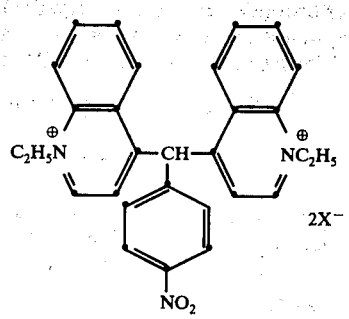

wherein $X^-$ is an acid anion.

9. A photographic film unit comprising:

a. a support having thereon at least one photosensitive silver halide emulsion layer having associated therewith a dye image-providing material;

b. a dye image-receiving layer;

c. means for discharging an alkaline processing composition within said film unit; and d. at least one layer containing at least one dye-forming compound having the formula:

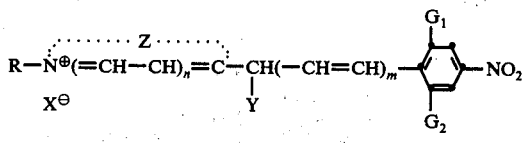

wherein:

*n* is 0 or 1;

*m* is 0 or 1;

Y is hydrogen, a carboxylic ester group or a carbamoyl group wherein, if *m* is 1, Y is hydrogen, and if *m* is 0, Y can additionally have the formula:

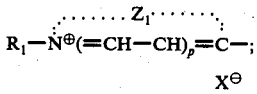

Z and $Z_1$ independently respresent the nonmetallic atoms necessary to complete a 5- or 6-membered heterocyclic ring whose skeletal atoms consist of the nitrogen atoms and carbon atoms depicted in the formula and at least one other atom chosen from the group consisting of carbon, nitrogen, oxygen, selenium and sulfur atoms;

R and $R_1$ are independently alkyl containing at least 4 carbon atoms;

*p* is 0 or 1;

$X^{63}$ is independently an acid anion; and $G_1$ and $G_2$ are independently selected from the group consisting of hydrogen or an electron-withdrawing group except that neither $G_1$ or $G_2$ can be nitro.

10. The film unit of claim 9 wherein said layer containing said compound having the formula:

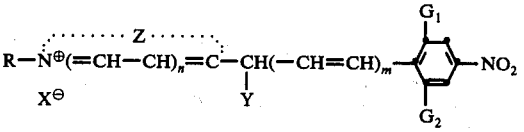

is located between said means for discharging alkaline processing composition and said silver halide emulsion layers.

11. The film unit of claim 9 wherein said layer containing said compound having the formula:

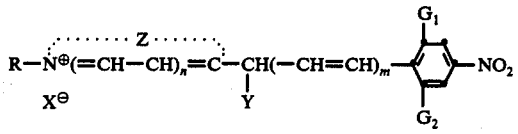

is located such that the processing composition penetrates said layer containing said compound prior to penetrating said silver halide layers.

12. The film unit of claim 9 also containing a neutralizing layer for neutralizing said alkaline processing composition after a predetermined time.

13. The film unit of claim 12 also containing a timing layer which is permeable by said alkaline processing composition after said predetermined time.

14. The film unit of claim 9 wherein said discharging means is a rupturable container containing said alkaline processing composition and an opacifying agent, said container being so positioned during processing of said film unit that a compressive force applied to said container will effect a discharge of the container's contents between said layer containing said compound having the formula:

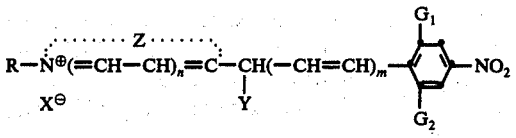

and said silver halide emulsion layer.

15. The film unit of claim 9 comprising:

a. a photosensitive element comprising a transparent support having thereon the following layers in sequence: an image-receiving layer according to claim 9, an alkaline solutionpermeable, light-reflective layer, an alkaline solutionpermeable, opaque layer, a red-sensitive silver halide emulsion layer according to claim 9 having a nondiffusible redox cyan dye releaser associated therewith, a green-sensitive silver halide emulsion layer according to claim 9 having a nondiffusible redox magenta dye releaser associated therewith, and a blue-sensitive silver halide emulsion layer according to claim 9 having a nondiffusible redox yellow dye releaser associated therewith;

b. a transparent sheet superposed over said blue-sensitive silver halide emulsion layer and comprising a transparent support coated with a neutralizing layer for neutralizing said alkaline processing composition after a predetermined time, a timing layer which is permeable by said alkaline processing composition after said predetermined time, and a layer containing a dye-forming compound according to claim 9 having the formula:

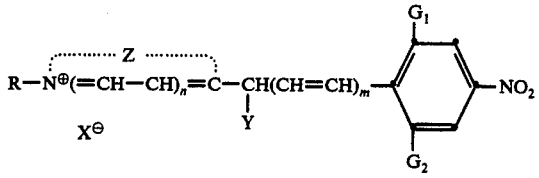

wherein R, Z, X, Y, $G_1$, $G_2$, *m* and *n* are as defined in claim 9 and c. a rupturable container containing said alkaline processing composition and an opacifying agent, said container being so positioned during processing of said assemblage that a compressive force applied to said container will effect a discharge of the container's contents between said transparent sheet and said blue-sensitive silver halide emulsion layer.

16. The film unit of claim 15 wherein each said redox dye releaser is a nondiffusible sulfonamido compound which is alkali-cleavable upon oxidation to release a diffusible color-providing moiety from the benzene nucleus, said compound having the formula:

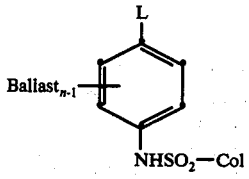

wherein:

a. Col is a dye or dye-precursor moiety;

b. Ballast is an organic ballasting radical of such molecular size and configuration as to render said compound nondiffusible during development in an alkaline processing composition;

c. L is OR or $NHR_1$ wherein R is hydrogen or a hydrolyzable moiety and $R_1$ is hydrogen or an alkyl group of 1 to 22 carbon atoms; and d. *n* is a positive integer of 1 to 2 and is 2 when L is OR or when $R_1$ is hydrogen or an alkyl group of less than 9 carbon atoms.

17. The film unit of claim 16 wherein each said silver halide emulsion is a direct-positive silver halide emulsion.

18. The film unit of claim 9 wherein said dye image-receiving layer is located on a separate transparent support superposed over the layer outermost from the support a) of claim 9 having thereon said photosensitive silver halide emulsion layer, said support of claim 9 being opaque.

19. The film unit of claim 9 additionally comprising a light-reflective material.

20. The film unit of claim 19 wherein the light-reflective material is $TiO_2$.

21. A photographic film unit comprising:

a. a support having thereon at least one photosensitive silver halide emulsion layer having associated therewith a dye image-providing material;

b. a dye image-receiving layer;

c. means for discharging an alkaline processing composition within said film unit; and d. at least one layer containing 1-butyl-2-p-nitrobenzylpyridinium bromide.

22. A photographic film unit containing a support having thereon at least one photosensitive silver halide emulsion layer and at least one layer containing at least one dye-forming compound having the structure:

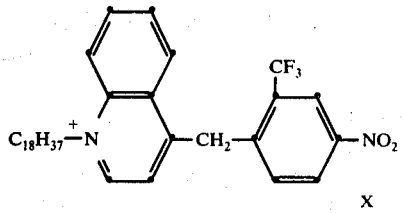

wherein $X^-$ is an anion.

23. A photographic film unit containing a support having thereon at least one photosensitive silver halide emulsion layer and at least one layer containing at least one dye-forming compound having the structure:

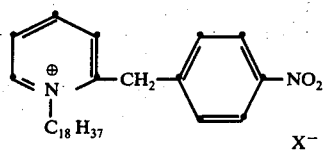

wherein $X^-$ is an anion.

24. A photographic film unit containing a support having thereon at least one photosensitive silver halide emulsion layer and at least one layer containing at least one dye-forming compound having the structure:

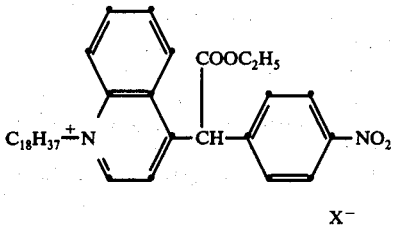

wherein $X^-$ is an anion.

25. A photographic film unit containing a support having thereon at least one photosensitive silver halide emulsion layer and at least one layer containing at least one dye-forming compound having the structure:

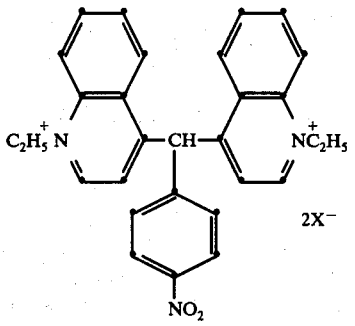

wherein $X^-$ is an anion.

26. A cover sheet for use with a color diffusion transfer film unit comprising a transparent support having thereon in sequence a neutralizing layer and a timing layer, and a layer comprising at least one essentially colorless compound having the formula:

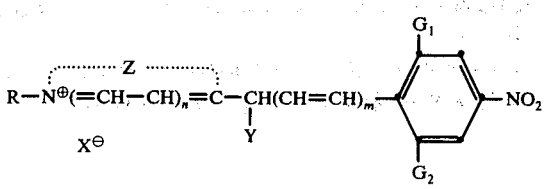

wherein:

$n$ is 0 or 1;

$m$ is 0 or 1;

Y is hydrogen, a carboxylic ester group or a carbamoyl group wherein, if $m$ is 1, Y is hydrogen, and if $m$ is 0, Y can additionally have the formula:

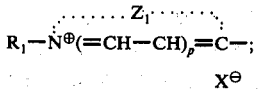

Z and $Z_1$ independently represent the nonmetallic atoms necessary to complete a 5- or 6-membered heterocyclic ring whose skeletal atoms consist of the nitrogen atoms and carbon atoms depicted in the formula and at least one other atom chosen from the group consisting of carbon, nitrogen, oxygen, selenium and sulfur atoms;

R and $R_1$ are independently alkyl containing at least 4 carbon atoms;

$p$ is 0 or 1;

$X^\ominus$ is independently an acid anion; and $G_1$ and $G_2$ are independently selected from the group consisting of hydrogen or an electron-withdrawing group except that neither $G_1$ nor $G_2$ can be nitro.

27. In a process of producing a photographic transfer image in color comprising:

a. imagewise-exposing a film unit containing a photographic element comprising comprising a support having thereon at least one photosensitive silver halide emulsion layer having associated therewith a dye image-providing material;

b. treating said element with an alkaline processing composition in the presence of a silver halide developing agent to effect development of each of said exposed silver halide emulsion layers;

c. an imagewise distribution of dye image-providing material being so formed as a function of development;

d. at least a portion of said imagewise distribution of dye image-providing material diffusing to a dye image-receiving layer;

e. a timing layer associated with a neutralizing layer being permeable by said alkaline processing composition after a predetermined time; and f. neutralizing said alkaline processing composition by means of said neutralizing layer associated with said photographic element after said predetermined time;

said film unit containing a silver halide developing agent, the improvement wherein said film unit contains a layer containing at least one dye-forming compound having the formula:

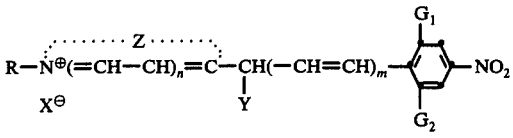

wherein:

$n$ is 0 or 1;

$m$ is 0 or 1;

Y is hydrogen, a carboxylic ester group or a carbamoyl group wherein, if $m$ is 1, Y is hydrogen, and if $m$ is 0, Y can additionally have the formula:

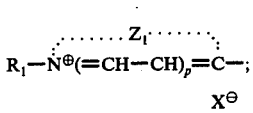

Z and $Z_1$ independently represent the nonmetallic atoms necessary to complete a pyridine, thiazole, selenazole, quinoline, imidazole and benzimidazole ring;

R and $R_1$ are independently alkyl containing at least 4 carbon atoms;

$p$ is 0 or 1;

$X^{\ominus}$ is independently an acid anion; and $G_1$ and $G_2$ are independently selected from the group consisting of hydrogen or an electron-withdrawing group except that neither $G_1$ nor $G_2$ can be nitro.

28. The process of claim 27 wherein said film unit comprises a transparent support having thereon the following layers in sequence: an image-receiving layer according to claim 27, an alkaline solution-permeable, light-reflective layer, an alkaline solution-permeable, opaque layer, a red-sensitive silver halide emulsion layer according to claim 27 having a nondiffusible redox cyan dye releaser associated therewith, a green-sensitive silver halide emulsion layer according to claim 27 having a nondiffusible redox magenta dye releaser associated therewith, and a blue-sensitive silver halide emulsion layer according to claim 27 having a nondiffusible redox yellow dye releaser associated therewith;

a transparent sheet superposed over said blue-sensitive silver halide emulsion layer and comprising a transparent support coated with a neutralizing layer for neutralizing said alkaline processing composition after a predetermined time, a timing layer which is permeable by said alkaline processing composition after said predetermined time and a layer containing a dye-forming compound according to claim 27 having the formula:

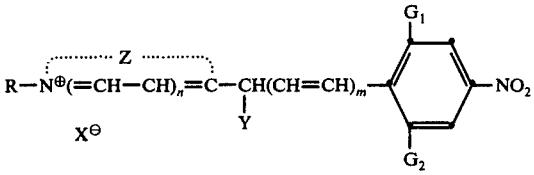

wherein:

$n$ is 0 or 1;

$m$ is 0 or 1;

Y is hydrogen, a carboxylic ester group or a carbamoyl group wherein, if $m$ is 1, Y is hydrogen, and if $m$ is 0, Y can additionally have the formula:

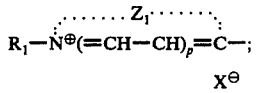

Z and $Z_1$ independently represent the nonmetallic atoms necessary to complete a pyridine, thiazole, selenazole, quinoline, imidazole and benzimidazole ring;

R and $R_1$ are independently alkyl containing at least 4 carbon atoms;

$p$ is 0 or 1;

$X^{\ominus}$ is independently an acid anion; and $G_1$ and $G_2$ are independently selected from the group consisting of hydrogen or an electron-withdrawing group except that neither $G_1$ nor $G_2$ can be nitro; and a rupturable container containing said alkaline processing composition and an opacifying agent, said container being so positioned during processing of said assemblage that a compressive force applied to said container will effect a discharge of the container's contents between said transparent sheet and said blue-sensitive silver halide emulsion layer.

* * * * *

UNITED STATES PATENT AND TRADEMARK OFFICE

CERTIFICATE OF CORRECTION

PATENT NO. : 4,081,275

DATED : March 28, 1978

INVENTOR(S) : Derek David Chapman and Thomas Irving Abbott

It is certified that error appears in the above-identified patent and that said Letters Patent are hereby corrected as shown below:

Title page, item [75], line 1, "Davis" should read --David--. Column 19, line 63, "where" should read --wherein--. Column 21, line 46, "solutionpermeable" should read --solution-permeable--; line 47, "solutionpermeable" should read --solution-permeable--. Column 22, line 5, that part of the formula reading "$(CH=CH)_m$" should read -- $(-CH=CH)_m$ --. Column 24, line 5, that part of the formula reading "$(CH=CH)_m$" should read -- $(-CH=CH)_m$ --; line 42, "comprising" (second occurrence) should be deleted. Column 26, line 10, that part of the formula reading "$(CH=CH)_m$" should read -- $(-CH-CH)_m$ -- .

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*